United States Patent [19]

Zahn

[11] 4,230,387

[45] Oct. 28, 1980

[54] CONTINUOUS CONNECTOR

[75] Inventor: Irwin Zahn, New York, N.Y.

[73] Assignee: General Staple Company, Inc., New York, N.Y.

[21] Appl. No.: 31,057

[22] Filed: Apr. 18, 1979

[51] Int. Cl.[3] ..... H01R 9/22; H01R 13/48

[52] U.S. Cl. ..... 339/59 M

[58] Field of Search ..... 339/59 M, 91 R, 276 SF

[56] References Cited

U.S. PATENT DOCUMENTS

| | | | |
|---|---|---|---|
| 2,396,725 | 3/1946 | Thomas, Jr. | 339/59 M |
| 2,931,006 | 3/1960 | Klumpp, Jr. | 339/59 M |
| 3,178,674 | 4/1965 | Scheller | 339/91 R |

*Primary Examiner*—Neil Abrams

*Attorney, Agent, or Firm*—Lerner, David, Littenberg & Samuel

[57] ABSTRACT

An endless connector is disclosed which comprises a continuous length of insulating material, the length of insulating material having electrical contacts spaced therealong and being provided with severance means intermediate said contacts for selectively severing said length of insulating material at locations intermediate said contacts. In one embodiment of the invention, the electrical contacts are imbedded in the length of insulating material, while in another embodiment, the continuous length of insulating material includes open ended cavities disposed intermediate the severance means with the contacts being disposed in the cavities.

6 Claims, 5 Drawing Figures

CONTINUOUS CONNECTOR

FIELD OF THE INVENTION

This invention relates to electrical connectors of the type which include an insulating body carrying or having disposed therein electrical contacts, and more particularly relates to an endless connector so designated because of its continuous length which facilitates, on an end user basis, the manufacture of a connector of any predetermined number of contacts.

BACKGROUND OF THE INVENTION

Electrical connectors comprising an insulating body having electrical contacts carried thereby are well known in the art. In the so-called male connectors, the insulating body carries pin-like contacts which extend above and below the insulating body to facilitate electrical connection from one element, such as a printed circuit board, to another element which may, for example, comprise a so-called female connector. As is well known, a female connector comprises an insulating body which carries an electrical contact which is generally capable of receiving at one end thereof a male pin, and at the other end thereof an electrical conductor which may be another male pin, a single electrical conductor, or a single strand of a multiconductor flat ribbon cable. Typically, the aforedescribed male connector and female connector are utilized in a tandem or interrelated fashion to provide electrical connection from one element such as the printed circuit paths on a printed circuit board to individual conductors or the multiple conductors of multiconductor ribbon cable.

The aforedescribed male and female type connectors are generally manufactured with a predetermined number of contacts carried thereby. For example, a typical male connector of the type described above might comprise a length of insulating material having ten, twenty, thirty, or any number of pins carried thereby. Similarly, a female connector may comprise a body of insulating material having individual cavities disposed therein, each cavity of which carries an electrical contact. Like the male connectors, the female connectors are commonly manufactured with ten, twenty, thirty, etc., contacts.

There are several drawbacks associated with the manufacture and use of both male and female connectors of the type described above. First, since the end user may not necessarily know or be able to anticipate the number of contacts he will ultimately require in a given situation, he must purchase an inventory of a variety of different size connectors, i.e., he must maintain a supply of ten-contact connectors, twenty-contact connectors, thirty-contact connectors, etc. Secondly, to the extent that a given electrical application only requires two electrical contacts to provide conduction between say two printed circuit paths on a printed circuit board and two electrical conductors, he is paying for but not using approximately 80% of the ten-contact connector. Likewise, if the given electrical application requires only 13 contacts, he has paid for but is not utilizing 7/20 of a twenty-contact connector.

SUMMARY OF THE INVENTION

In accordance with the present invention, an endless connector is provided which comprises a continuous length of insulating material with the length of insulating material having electrical contacts spaced therealong and being provided with severance means intermediate the contacts for selectively severing the length of insulating material at locations intermediate the contacts. In this manner, the end user need only store the continuous or endless connector of the instant invention and, in a given application, can sever the continuous length of insulating material in such a fashion that the resultant connector comprises exactly the number of contacts which is required for his particular electrical application.

In one embodiment of the instant invention, the endless connector is of the so-called male type in the sense that it includes a body of insulating material which has pins embedded therein. In another embodiment, the connector is of the so-called female type having side-by-side cavities within which are disposed female type contacts. In accordance with an other feature of the instant invention, the male and female type connectors are provided with interconnection means by which they may coact with one another to provide an electrical connection from one point, for example, an electrified aperture in a printed circuit board, through the male and female connectors to individual electrical connectors or the strands of a multiconductor flat ribbon cable.

Accordingly, it is an object of the instant invention to provide an endless connector comprising a continuous length of insulating material, said length of insulating material having electrical contacts spaced therealong and being provided with severance means intermediate said contacts for selectively severing said length of insulating material at locations intermediate said contacts.

It is a further object of the instant invention to provide such an endless connector which facilitates the easy production, at the end user level, of electrical connectors having a predetermined desired number of electrical contacts carried thereby.

Yet another object of the instant invention is to provide such an endless connector which may be of the male or female type.

Yet another object of the instant invention is to provide such an endless connector wherein the male and female types are provided with interconnection means to facilitate interconnection therebetween.

Other objects of the instant invention will be had by referring to the following specification and drawings.

DETAILED DESCRIPTION

Figure 1:
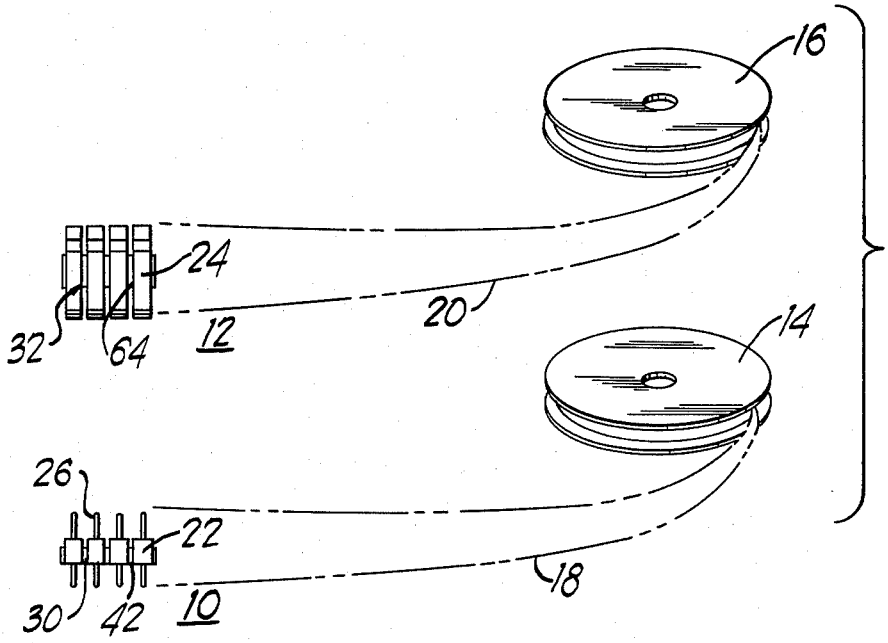
FIG. 1 is a view illustrating endless connectors of the male and female type constructed in accordance with the instant invention.

Turning to the figures, wherein like numerals designate like parts, there is shown in FIG. 1 an endless connector 10 of the male type and an endless connector 12 of the female type, both of which are constructed in accordance with the instant invention. As suggested by the reels 14 and 16 and the phantom lines 18 and 20, respectively, the endless connectors 10 and 12 are, in fact, continuous in nature and are unwound from their respective reels 14 and 16 as needed. Before going into detail, it may be noted that both the male and female type of endless connector constructed in accordance with the principles of the instant invention comprise a continuous length of insulating material 22, 24, respectively, contacts 26 and 28, respectively, and severance means 30 and 32, respectively, for selectively severing the length of insulating material at locations intermediate the contacts. In accordance with the invention, one only has to sever the insulating material 22 or 24 at any desired severance means 30, 32, to produce a male or female connector having the exact number of contacts 26, 28, desired.

Figure 2:
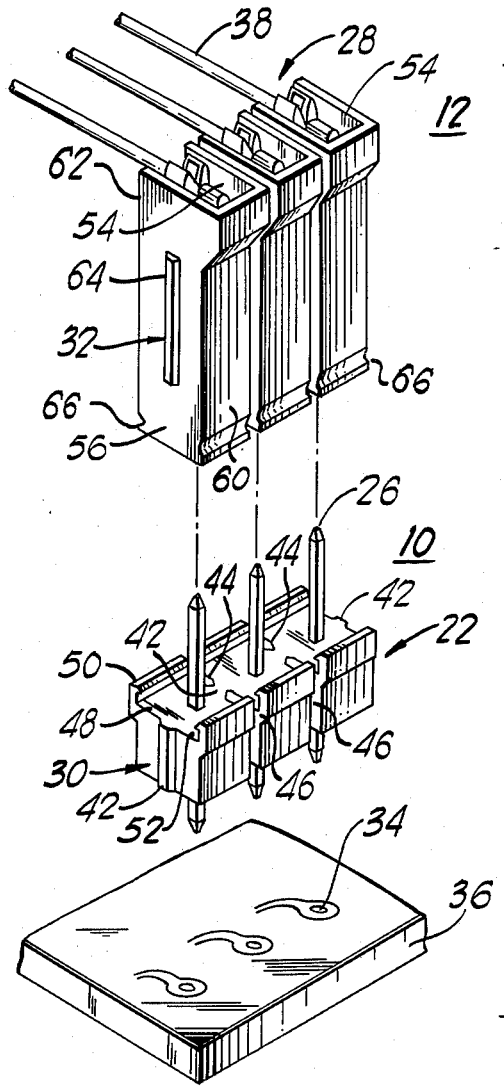
FIG. 2 is a perspective view of three contact connectors of the male and female type constructed in accordance with the instant invention and further illustrating the manner in which such connectors may cooperate to provide electrical connection from a printed circuit board to electrical conductors.

Turning to FIG. 2, there are shown three contact male and female connectors 10 and 12 which have been formed from the endless connectors shown in FIG. 1. As will become apparent, in the particular application illustrated in FIG. 2, the connectors 10 and 12 have been selected to provide electrical connection from three conductive apertures 34 provided in a printed circuit board 36 through the contacts 26 and 28 to three electrical conductors 38.

Figure 3:
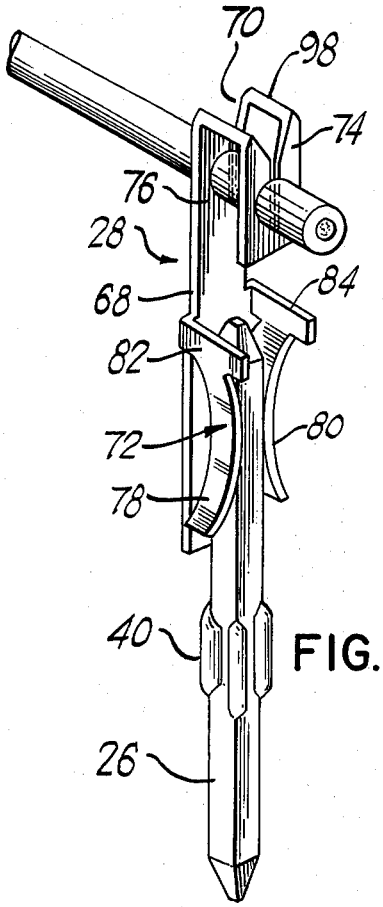
FIG. 3 is a perspective view illustrating the mechanical and electrical interconnection of the male and female contacts employed in the connectors of FIG. 2.

As seen in FIGS. 2 and 3, the contacts 26 of the male conductor 10 are embedded by preferably being press-fitted within the length of insulating material 22, and, to that effect, the central portions 40 of the pin 26 are swedged or enlarged. As can best be seen in FIG. 2, the severance means 30 comprises reduced cross-sectional areas 42 of the insulating material 22 which are preferably defined by pairs of non-touching slots 44 and 46. Accordingly, to form a three-pin connector 10 from the endless connector of FIG. 1, one need only snap or break the continuous length of insulating material 22 at the appropriate severance means 42.

As also seen in FIG. 2, the upper surface 48 of the insulating material 22 includes upstanding and inwardly directed locking ribs 50 and 52 along opposite longitudinal edges thereof. As will be further explained, such locking ribs form part of the interconnection arrangement which facilitates the joining of male and female connectors 10 and 12 when that particular type of arrangement is desired for a particular electrical application.

Figure 4:
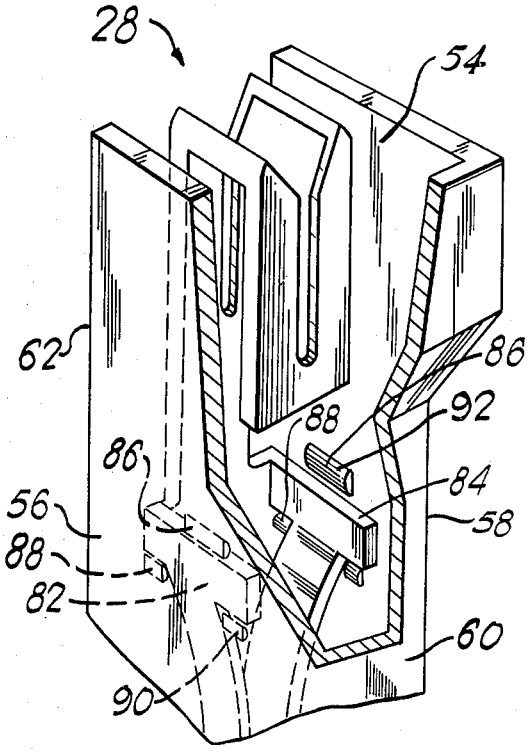
FIG. 4 is a perspective view, partly in section, illustrating the manner in which the female contacts are retained within the female connector.

Considering FIGS. 2, 3 and 4, it may be seen that in the female connector 24, the continuous length of insulating material 24 includes side-by-side open ended cavities 54 defined by side walls 56, 58, and front and rear walls 60 and 62. In the case of the female connector 24, the severance means 32 comprises breakable joining webs 64 joining adjacent side walls 56 and 58 of adjacent cavities 54. Again, to form a connector 24 of any desired number of contacts, the endless connector may be broken at the appropriate joining web 64.

The lower surface of the female connector 24 includes outstanding locking nibs 66 along opposite edges thereof, which nibs may be snapped into and locked under the inwardly directed locking ribs 50 and 52 of a male connector 10 when it is desired to interconnect the male and female connectors to produce the electrical connection illustrated in FIG. 3.

With reference to FIG. 3, it can be seen that the contacts 28 employed in the female connector 12 comprise a generally planar central region 68 at the opposite ends of which are provided a first reception means 70 and a second reception means 72. Although not intended to be limited, the reception means 70 may be of the insulation piercing type comprising slotted metallic regions 74 and 76, while the second reception means 72 may be defined by opposed conductive shoes 78 and 80 between which a contact pin such as 26 may be slidably received. The conductive shoes 78 and 80 depend from shoulder regions 82 and 84 which are outstanding from the central region 68.

FIG. 4 illustrates the manner in which the contacts 28 may be located and held within the cavities 54 of the female contact 12. Thus, the inner surfaces of the side walls 56 and 58 of each cavity 54 are provided with inwardly directed projections or nibs 86, 88 and 90, which capture the aforementioned shoulders 82 and 84 to retain the contact 28 within the cavity 54. It will be appreciated that the projections 86 are beveled at 92 to facilitate the insertion of the contacts 28 within the cavities.

Figure 5:
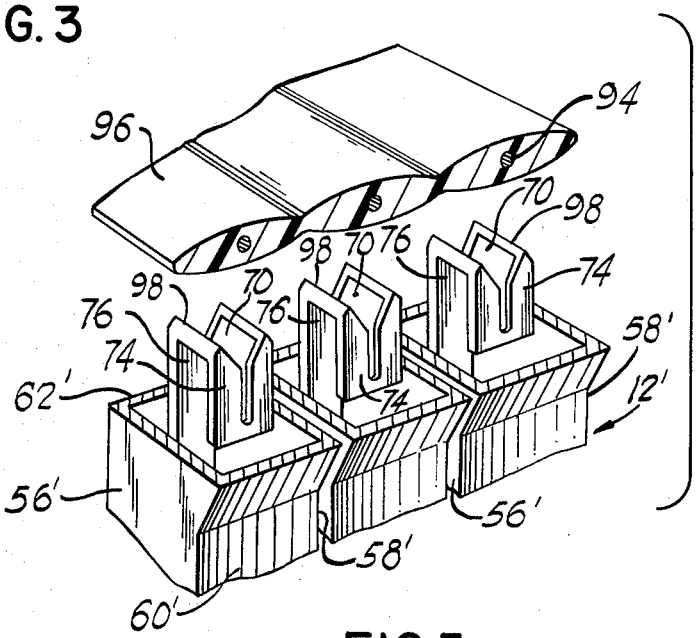
FIG. 5 is a perspective view, partly in section, illustrating an alternative embodiment of a female connector constructed in accordance with the instant invention, modified so as to accept multiconductor ribbon cable.

Turning to FIG. 5, wherein corresponding parts have been designated by primed numerals, there is shown an alternative embodiment in which the female connector 12' differs from the connector 12 of FIG. 2 in that the walls 56', 58', 60' and 62' defining each cavity terminate lower than the corresponding walls of the cavities of FIG. 2 such that the insulation piercing reception means 70 of the contacts 28 are physically exposed above their respective cavities. In this manner, the insulation piercing reception means 70 may accommodate the strands 94 of a multiconductor ribbon cable 96 in a conventional manner, that is, by forcing the multiconductor ribbon cable downwardly such that the conductor strands 94 enter the slotted reception means 70 and the upper portions 98 thereof pierce through the insulation of the multiconductor ribbon cable 96.

Although this invention has been described with respect to its preferred embodiments, it should be understood that many variations and modifications will now be obvious to those skilled in the art, and it is preferred, therefore, that the scope of the invention be limited, not by the specific disclosure herein, but only by the appended claims.

What is claimed is:

1. An endless connector arrangement comprising a first continuous length of insulating material, said first length of insulating material having electrical contacts spaced therealong and being provided with severence means intermediate said contacts for selectively severing said first length of insulating material at locations intermediate said contacts;

a second continuous length of insulating material, said second length of insulating material having electrical contacts spaced therealong and being provided with severance means intermediate said contacts for selectively severing said second length of insulating material at locations intermediate said contacts;

one surface of said first length of insulating material and one surface of said second length of insulating material having interconnection means for removably joining said first and second lengths of insulating material.

2. The endless connector arrangement of claim 1, wherein the contacts of said first length of insulating material and the contacts of said second length of insulating material are removably connected to each other when said first and second lengths of insulating material are removably joined.

3. The endless connector arrangement of claim 2, wherein the contacts of said first length of insulating material comprise elongated pins, and the contacts of said second length of insulating material include reception means at at least one end thereof for receiving said elongated pins.

4. The endless connector arrangement of claim 2, wherein said one surface of said first length of insulating material includes upstanding locking ribs, and said one surface of said second length of insulating material includes outstanding locking ribs which are received by said locking ribs when said first and second lengths are removably joined; said locking ribs and said outstanding locking ribs comprising said interconnection means.

5. The endless connector arrangement of claim 4, wherein the contacts of said first length of insulating material comprise elongated pins, and the contacts of said second length of insulating material include reception means at at least one end thereof for receiving said elongated pins.

6. The endless connector arrangement of claim 1, wherein said one surface of said first length of insulating material includes upstanding locking ribs, and said one surface of said second length of insulating material includes outstanding locking ribs which are received by said locking ribs when said first and second lengths are removably joined; said locking ribs and said outstanding locking ribs comprising said interconnection means.

* * * * *